US008499496B2

(12) United States Patent
Picchio

(10) Patent No.: US 8,499,496 B2
(45) Date of Patent: Aug. 6, 2013

(54) SLIDING DOOR SYSTEM

(75) Inventor: Cesare Picchio, Vedano al Lambro (IT)

(73) Assignee: Unifor S.p.A., Turate, Como (IT)

( * ) Notice: Subject to any disclaimer, the term of this patent is extended or adjusted under 35 U.S.C. 154(b) by 928 days.

(21) Appl. No.: 12/198,924

(22) Filed: Aug. 27, 2008

(65) Prior Publication Data

US 2009/0056228 A1 Mar. 5, 2009

(30) Foreign Application Priority Data

Aug. 27, 2007 (CA) ..... 2599045

(51) Int. Cl.
*E05D 15/06* (2006.01)

(52) U.S. Cl.
USPC ..... 49/411; 49/409; 49/404; 52/207

(58) Field of Classification Search
USPC ..... 49/409, 410, 411, 404; 52/29, 207
See application file for complete search history.

(56) References Cited

U.S. PATENT DOCUMENTS

| | | | | | |
|---|---|---|---|---|---|
| 1,269,133 | A | * | 6/1918 | Townsend | 16/93 R |
| 1,287,730 | A | * | 12/1918 | Moylan | 49/410 |
| 3,089,203 | A | * | 5/1963 | Roselius | 49/409 |
| 3,727,349 | A | * | 4/1973 | Bainbridge | 49/411 |
| 3,842,462 | A | * | 10/1974 | Bainbridge | 16/94 R |
| 4,272,923 | A | * | 6/1981 | Anderson | 49/360 |
| 4,854,078 | A | * | 8/1989 | DePrima | 49/409 |
| 5,966,879 | A | * | 10/1999 | Verbeek et al. | 52/205 |
| 6,131,340 | A | * | 10/2000 | Clark et al. | 49/410 |

* cited by examiner

*Primary Examiner* — Gregory J. Strimbu
(74) *Attorney, Agent, or Firm* — Shoemaker and Mattare

(57) ABSTRACT

A door is secured in spaced relation to a wall panel by a support assembly which includes a tubular housing secured to the wall and an elongate guide bar secured to the door at its bottom. The door is retained, at its top, between extruded aluminum abutments which allow the door to slide with respect to the wall panel, but prevent the door from pivoting about the guide bar.

10 Claims, 3 Drawing Sheets

SLIDING DOOR SYSTEM

FIELD OF THE INVENTION

The present invention relates to guides for sliding-style doors.

BACKGROUND OF THE INVENTION

In the furniture industry and in home construction it is commonplace to construct generally planar doors and to mount them in a manner which permits same to be moved along a horizontal axis, parallel to the plane of the door. Doors of this general type are commonly termed "sliding doors" or "sliders", although, for smooth movement, particularly in the context of relatively massive doors, wheels or rollers can be provided, such that same are more correctly described as sliding-style doors. A typical construction includes a doorway or opening, a door of similar size, and upper and lower tracks upon which the door rides for movement between open and closed positions.

SUMMARY OF THE INVENTION

A system for use with a wall and a door forms one aspect of the invention. The wall has a longitudinal length, a height and a lateral thickness and the door has a width, a height and a thickness. The system comprises a support assembly and a support. The support assembly includes a first portion and a second portion. The first portion is secured, in use, to said wall, to define a longitudinal axis. The second portion, in use, is secured to said door and mounted to the first portion in a manner to support said door, when said door is supported otherwise than by the second portion at least as against pivotal movement about the axis, for longitudinal movement between a retracted position whereat a portion of said door is disposed laterally from the wall and an extended position whereat said portion projects longitudinally beyond and in cantilevered relation to said wall. The support operatively mounts said door to said wall in use to support said door at least against pivotal movement about the axis while permitting said longitudinal movement of the door.

A system for use with a planar wall and a planar door forms another aspect of the invention. The wall has a longitudinal length, a height and a lateral thickness and the door has a width, a height and a thickness. The system comprises a support assembly and a support. The support assembly includes a guide bar and a housing. One of the guide bar and the housing is secured, in use, to said wall, to define a longitudinal axis. The other of the guide bar and the housing is secured, in use, to said door. In use, the guide bar and the housing are mounted to one another to support the door, when the door is orientated parallel to said wall, for longitudinal movement between a retracted position whereat a portion of said door is disposed laterally from the wall and an extended position whereat said portion projects longitudinally beyond and in cantilevered relation to said wall. The support is rigidly secured, in use, to one of said door and said wall, above the support assembly, to support the door parallel to said wall while permitting said longitudinal movement of the door.

A system for selectively dividing a space into two portions forms another aspect of the invention. The system comprises a panel, a door, a support assembly and a support. The panel is positionable, in use, to define a wall dividing said space into said two portions, said two portions being communicable with one another by a doorway, and, in use, has a longitudinal length, a height and a lateral thickness. The door has a width, a height and a thickness. The support assembly and the support, in use, support the door for longitudinal movement between a retracted position whereat a portion of said door is disposed laterally from the wall and an extended portion whereat said portion projects longitudinally beyond and in cantilevered relation to said wall to occlude said doorway. The support assembly includes a guide bar and a housing. One of the guide bar and the housing is secured, in use, to said wall, to define a longitudinal axis. The other of the guide bar and the housing is secured, in use, to said door. The guide bar and the housing are mounted to one another for reciprocation. The support is rigidly secured, in use, to one of the wall and the door, above the support assembly, and is adapted to support the door against pivotal movement about the axis while permitting said longitudinal movement of the door.

The system provides for the mounting of a door for movement in the manner of a sliding-style door which is characterized by the absence of tracks spanning the doorway. The absence of tracks traversing the doorway improves aesthetics and functionality. Notably, this construction avoids the trip hazard associated with a lower track and the head clearance problems associated with an upper track.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

DETAILED DESCRIPTION

Figures 1, 2:
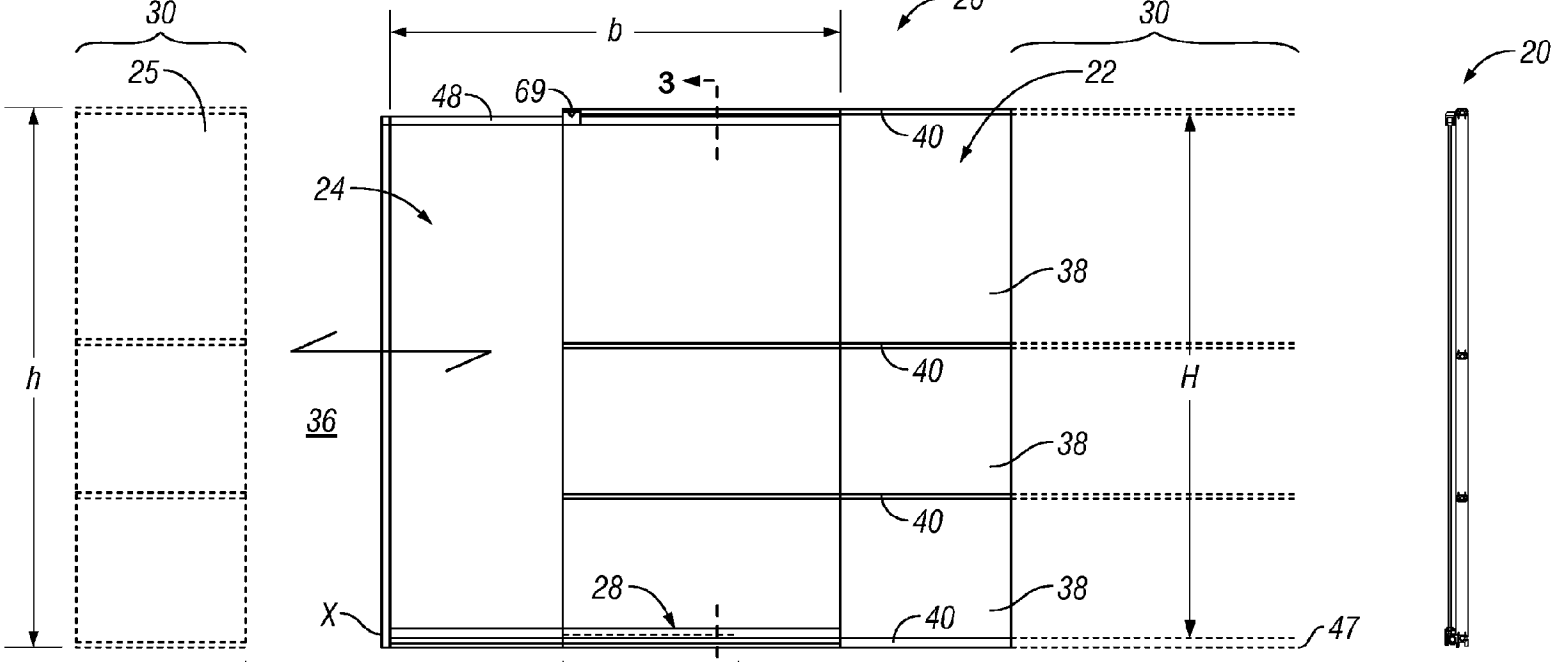
FIG. 1 is a side view of a partition according to an exemplary embodiment of the invention.
FIG. 2 is an end view of the structure of FIG. 1.
Figure 3:
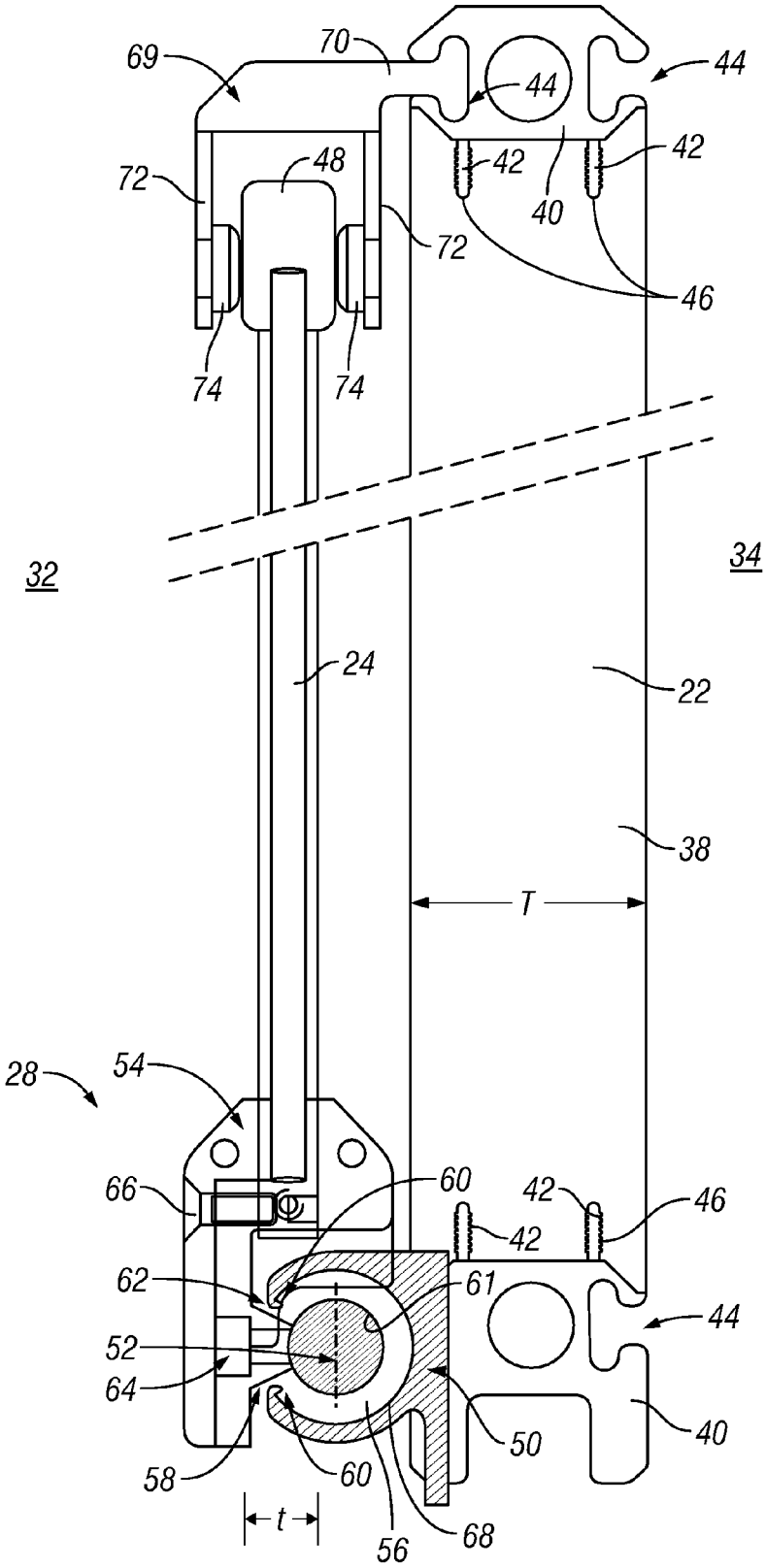
FIG. 3 is a partial view along section 3-3 of FIG. 1.

An exemplary system for selectively dividing a space into two portions is shown in FIGS. 1-3 and designated with general reference numeral 20

The system 20 comprises a panel 22, a door 24, a support 69 and a support assembly 28.

The panel 22 in use, has a longitudinal length B, a height H and a lateral thickness T and is positionable, as shown, to define a planar wall 30 dividing said space into said two portions 32 and 34, said two portions 32 and 34 being communicable with one another by a doorway 36, which in the embodiment illustrated is defined by the space between panel 22 and a secondary panel 25 which also forms part of the exemplary wall 30. The panel 22 illustrated in FIGS. 1-3 comprises a panel 38 of MDF or the like interleaved between longitudinally-extending extruded aluminum connectors 40 which have peripherally-grooved protuberances 42 extending horizontally therefrom and laterally-outwardly projecting channels 44 defined therein. The protuberances 42 fit in bores 46 formed in panel 38 to securely connect the panel 38 to the connectors 40 in press-fit relation. Although not illustrated, it should be understood that, in use and in this embodiment, panel 22 is suitably supported such that the wall 30 is a stable, upright element.

With reference to FIGS. 1-3, the door 24 is a planar panel of MDF or the like and has a width b, a height h and a thickness t, and the sides and top of the door 24 are capped with an extruded aluminum frame 48.

The support assembly 28 includes: a first portion, in this embodiment taking the form of a housing 50; a second portion, in this embodiment taking the form of an elongate guide bar 52; a guide bar support 54 and an open sleeve rolling bearing 56.

The housing 50 is an extruded elongate aluminum cylindrical tube having a longitudinal opening 58, defining an axis X-X and secured, in use, lengthwise along and to the wall 30, adjacent the lowermost connector 40. Inwardly-directed lips 60 are formed on edges of said cylindrical tube which define said longitudinal opening 58.

The guide bar 52 is an iron bar ground to have an outer cylindrical surface 61 and is provided with a set of radial threaded dead end holes (not shown).

The guide bar support 54 is a further aluminum extrusion which supports the guide bar 52 over its overall length in order to prevent inflection and, therefore, guidance inaccuracy and is provided with a tapered portion 62 which is straddled by the housing 50 and which ends in a surface which mates with the surface 61 of the guide bar 52. The guide bar support 54 is provided with a plurality of through holes 64 which, in assembly, are aligned with the radial threaded dead end holes of guide bar 52 and through which fastening bolts (not shown) extend, to secure the guide bar 52 to the guide bar support 54. The guide bar support 54, in turn, is secured to the lower periphery of the door 24 by a plurality of screws 66. So mounted, the guide bar 52 extends widthwise and across substantially the entirety of the width b of the door 24.

The open sleeve rolling bearing 56 is of a type employing recirculating balls (not shown) and is disposed in the housing 50 such that the ball bearings thereof are disposed in rolling relationship between the outer cylindrical surface 61 of the guide bar 52 and an inner cylindrical surface 68 of the housing 50, with the lips 60 preventing rotation of the open sleeve rolling bearing 56 with respect to the cylindrical tube housing 50. The guide bar 52 is thus mounted to the housing 50 for smooth, axial reciprocation.

The support 69 illustrated in FIGS. 1-3 takes the form of an aluminum extrusion and has a laterally extending leg 70 which extends into and in mechanical engagement with the channel 44 of the uppermost connector 40, so as to be rigidly secured to the wall 30, atop the door 24 and above the support assembly 28. A pair of abutment portions 72 extend from leg 70 and are disposed in laterally-straddling relation to said door 24, that is, in laterally spaced relation to one another and on opposite sides of the door 24. The abutment portions 72 include pads 74 of self-lubricating material such as polytetrafluorethylene which capture the frame 48 therebetween in close-fitting, spaced relation.

The support assembly 28 and support 69, in use, support the door 24 substantially parallel to the plane of the wall 30 for longitudinal, i.e. axial movement. In use, the support assembly 28 supports the mass of the door 24 for smooth movement via the bearing 56. The support 69 supports the door against rotation about the axis X-X, with the pads 74 of the abutment portions 72 and the frame 48 of the door 24 engaging one another in a relatively friction-free manner so as to not to add unduly to sliding friction.

The door 24 is thus manually movable between a retracted position whereat substantially the entirety of the door 24 is disposed laterally from wall 30 (i.e. outside the doorway) and an extended position whereat a portion of door 24 projects longitudinally beyond said wall 30 and in cantilevered relation thereto to occlude said doorway 36.

In the context of the illustrated structure, it has been found to be advantageous, to minimize binding, to provide the door 24 with a width b that is at least 1.5 times the width a of the doorway 36, that is, the longitudinal distance by which the door 24 extends beyond the wall 30 in the extended position. Similarly, the length c of the portion of the support assembly secured to the wall, in this exemplary embodiment, the housing 50, measured axially, will advantageously be adjusted to be equal to the difference between b and a. Generally, the width a of the doorway should be about 1 meter, to provide an adequate walking clearance, and the heights H,h of the wall 30 and door 24 should be less than 2 meters.

Figure 4:
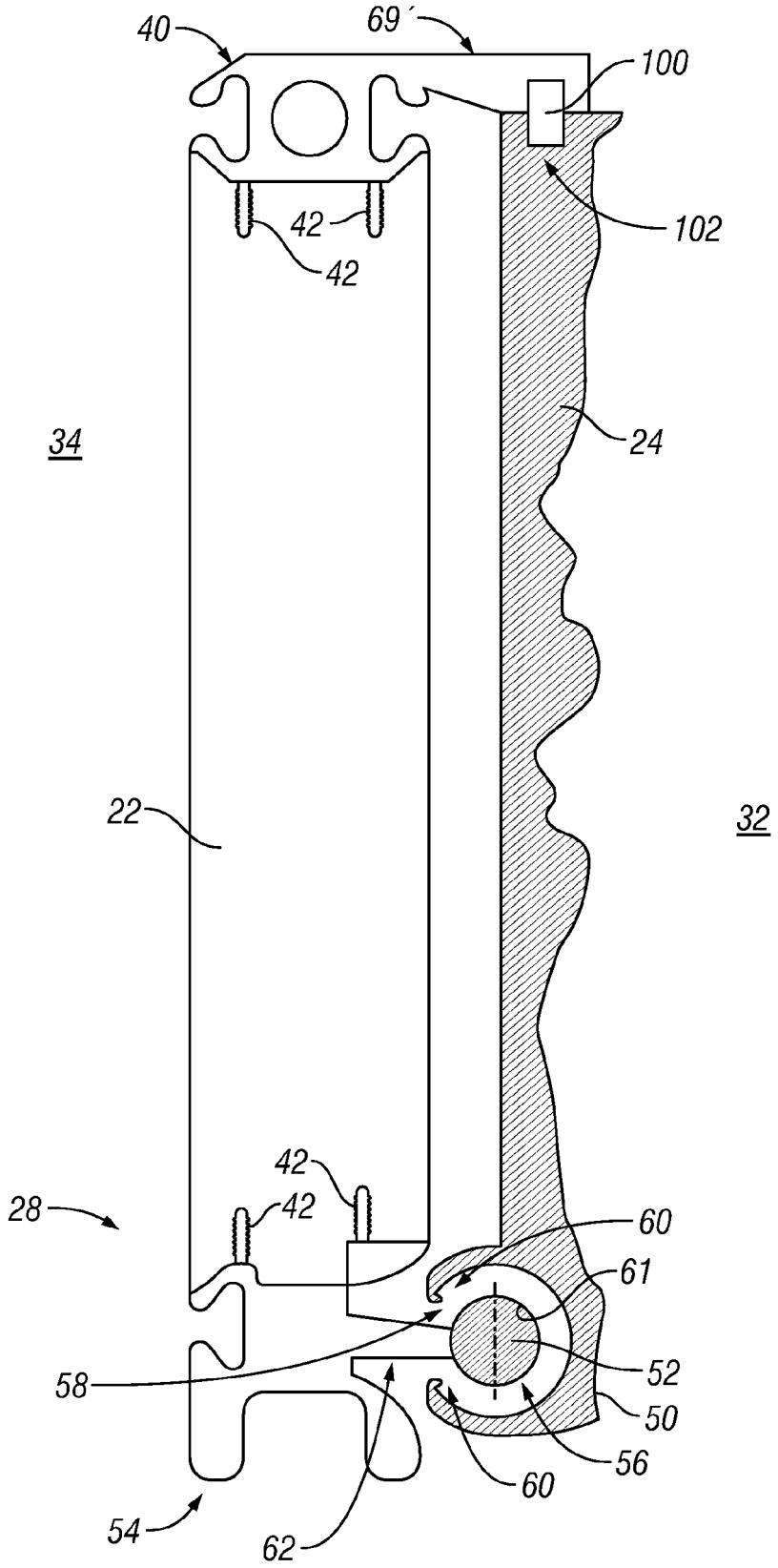
FIG. 4 is a view similar to FIG. 3 of a partition according to a further exemplary embodiment.

A further exemplary embodiment of the system is shown in FIG. 4. This system is similar to the embodiment of FIG. 3, and, to the extent that the systems of FIGS. 3 and 4 are identical, they are referenced accordingly. However, whereas in the embodiment of FIGS. 1-3 there is shown a support 69 rigidly secured to the wall 22 and which straddles the door 24 to permit sliding movement of the door therethrough, in this embodiment, a modified support 69' is provided, which is rigidly secured to the wall 22 (formed integrally with the upper connector 40 thereof) and which carries a pad 100 of polytetrafluorethylene or other self-lubricating material which, in the course of movement of the door 24, slides along a slot 102 formed in the door 24, thereby to support door 24 against rotation about axis X-X without adding unduly to sliding friction. As well, whereas in the embodiment of FIGS. 1-3, the guide bar 52 is rigidly secured to the door 24 and the housing 50 is rigidly secured to the wall 22, in the embodiment of FIG. 4, the guide bar 52 is secured to the wall 22 and the housing 50 is secured to and spans the width of the door 24.

Whereas but two embodiments are herein shown and described by way of example, it should be understood that various modifications thereto are contemplated.

For example, whereas the illustrated door is disposed in a generally outboard relation to the wall/panel, it should be understood that the door could be deployed in an interior relation to the wall, i.e. in the manner of a pocket door.

Similarly, whereas specific constructions of the door and panel are herein shown, it will be understood that the support assemblies of the present invention could be deployed in use with doors and panels of widely varying configuration.

Additionally, whereas pads of polytetrafluorethylene self-lubricating material are suggested for the support, it will be evident that other plastics and materials could be utilized, and indeed, altogether different arrangements for the support could be utilized A pair of wheels, for example, could be arranged on opposites sides of the door for support against pivotal movement. Yet further, a second guide bar/housing combination could be provided for the support.

Further, whereas the panel 22 of FIG. 1 defines a doorway in conjunction with a second panel 25, it should be understood that the doorway could be defined wholly within a single panel, or could be defined by a single panel, spaced apart from and orientated perpendicular to another wall.

Accordingly, it should be understood that the invention is to be limited only by the claims appended hereto, purposively construed.

The invention claimed is:

1. A system for use with a wall defining a doorway, the wall having a longitudinal length, a height and a lateral thickness, and a door having a width, a height and a thickness, the system comprising:

a first support assembly for holding the door spaced from the wall while allowing the door to slide parallel to the wall, said first support assembly including a first portion secured, in use, to said wall, to define a longitudinal axis; and a second portion secured to said door and mounted to the first portion in a manner to support said door against pivotal movement about said longitudinal axis and to permit longitudinal movement of the door between a retracted position wherein the door is spaced away from said doorway and an extended position wherein the door lies across said doorway;

wherein the first portion is a housing secured to said wall, the second portion is an elongate guide bar secured to said door, the wall comprises a panel mounted between longitudinally extending upper and lower extruded aluminum connectors each of which has peripherally-grooved protuberances extending vertically therefrom and at least one longitudinally extending channel defined therein, the housing is an extruded elongate aluminum cylindrical tube having a longitudinal opening and is secured lengthwise along and to the wall, adjacent said lower connector, and a second support operatively mounting said door to said wall to support said door and to prevent said pivotal movement of said door about said longitudinal axis while permitting said longitudinal movement of the door, wherein the second support is an aluminum extrusion and has a laterally extending leg which engages in said longitudinally extending channel of said upper connector, so as to be rigidly secured to the wall above the door.

2. A system according to claim 1, wherein in the retracted position, substantially the entire door is spaced away from said doorway.

3. A system according to claim 2, wherein, in use b>1.5a wherein b is the width of said door and a is the a width of the doorway.

4. A system according to claim 3, wherein, in use c=b-a wherein c is a longitudinal length of the first portion.

5. A system according to claim 4, wherein the second portion extends substantially the entire width of the door.

6. A system according to claim 1, further comprising a plurality of ball bearings disposed between the first portion and the second portion.

7. A system according to claim 6, wherein the guide bar has an outer cylindrical surface and the ball bearings are retained in said cylindrical tube in rolling relationship with the outer cylindrical surface of the guide bar.

8. A system according to claim 6, wherein a pair of inwardly directed lips of said cylindrical tube define said longitudinal opening for retaining said plurality of ball bearings in said cylindrical tube.

9. A system according to claim 1, wherein the second support is disposed atop and straddles said door.

10. A system according to claim 9, wherein the second support includes a pair of abutment portions disposed on opposite sides of said door.

* * * * *